United States Patent [19]

Tudor

[11] 4,252,242

[45] Feb. 24, 1981

[54] CLOTHING RACK

[76] Inventor: Charles L. Tudor, 119 Millbury Ave., Millbury, Mass. 01527

[21] Appl. No.: 959,568

[22] Filed: Nov. 13, 1978

[51] Int. Cl.[3] ..... A47F 7/24

[52] U.S. Cl. ..... 211/96; 211/104

[58] Field of Search ..... 211/96, 97, 105.1, 123, 211/105.3, 1.3, 104

[56] References Cited

U.S. PATENT DOCUMENTS

| | | | |
|---|---|---|---|
| 551,403 | 12/1895 | Proctor | 211/207 |
| 1,726,786 | 4/1928 | Whitney . | |
| 1,797,037 | 3/1931 | Wolff | 211/96 |
| 2,453,919 | 11/1948 | Johnson et al. | 211/96 |
| 2,461,457 | 2/1949 | Weber | 211/102 X |
| 2,816,668 | 12/1957 | Marshall | 211/104 |
| 2,875,903 | 3/1959 | Shourds . | |
| 3,015,398 | 1/1962 | Norbereit | 211/96 |
| 3,032,273 | 5/1962 | Spielman | 211/105.3 X |
| 3,202,293 | 8/1965 | Franklin | 211/96 |
| 3,417,874 | 8/1967 | Bryant | 211/100 |
| 3,436,046 | 9/1967 | Valeska | 248/284 |
| 4,006,826 | 2/1977 | Rich | 211/101 |
| 4,029,211 | 6/1977 | Marshall | 211/104 |

FOREIGN PATENT DOCUMENTS

| | | | |
|---|---|---|---|
| 162215 | 4/1958 | Sweden | 211/104 |

*Primary Examiner*—Roy D. Frazier
*Assistant Examiner*—Robert W. Gibson, Jr.
*Attorney, Agent, or Firm*—Norman S. Blodgett; Gerry A. Blodgett

[57] ABSTRACT

Clothing rack having a pivot mounting secured to a vertical surface, having an arm attached at one end to the pivot mounting by a pivot means to make the arm swingable in a horizontal plane, and having a rod with one end attached to the other end of the arm by a pivot means to make the rod independently swingable in a horizontal plane.

3 Claims, 5 Drawing Figures

CLOTHING RACK

BACKGROUND OF THE INVENTION

In most households, the bedroom closets are provided with a horizontal rod from which clothing is suspended by use of hangers. Access to the clothing on such a rod is usually not difficult if the closet door extends the full width of the closet, particularly if only a few hangers are used. When, however, the door is narrower than the closet and when it is desired to place large amounts of clothing on the rod, certain difficulties are experienced. One of the major difficulties encountered is that it is difficult to see the clothing clearly, even when the closet is provided with an interior light. Colors are very difficult to observe accurately where there is no light. Where the door is very small, there are dark areas. Also, the fact that a person is standing in the doorway and shutting off light from the exterior accentuates the problem. In other words, in almost every arrangement of closets, not only is it difficult to see the colors of the clothing clearly, but it is difficult to obtain access to a particular piece of clothing, either because it is located to one side, or because the clothing is tightly packed on the rod. Removing one particular piece of clothing disarrays other pieces of clothing and pulls them from their hangers. It has been suggested that a clothing rack on wheels be used that could be rolled outside of the closet where the light and access are better; such a wheeled rack is not practical in a closet because, as is usually the case, the floor of the closet is fully occupied with shoes and the like. These and other difficulties experienced with the prior art devices have been obviated in a novel manner by the present invention.

It is therefore, an outstanding object of the invention to provide a clothing rack that permits the entire body of clothing in a closet to be moved exterior of the closet on occasion.

Another object of this invention is the provision of a clothing rack, particularly for use with a closet which is considerably wider than the access door.

A further object of the present invention is the provision of a clothing rack which permits observation of the clothing in natural light, despite darkness or artificial light in a closet.

It is another object of the instant invention to provide a clothing rack which permits the clothing to be carried outside of the closet, despite the presence of shoes and the like on the closet floor.

It is another object of the instant invention to provide a clothing rack which is simple in construction, inexpensive to manufacture, and which is capable of a long life of useful service with a minimum of maintenance.

A still further object of the invention is the provision of a clothing rack of the articulated type which can readily be applied to existing closets.

With these and other objects in view, as will be apparent to those skilled in the art, the invention resides in the combination of parts set forth in the specification and covered by the claims appended hereto.

SUMMARY OF THE INVENTION

In general, the invention consists of a retractable clothing rack for use in an inner space consisting of right and left side walls, rear wall, and a front wall with a doorway situated intermediate between the right and the left side walls. A pivot mount is mounted on the inside of the front wall and a first arm is attached at one end to said pivot mount by a first pivot means having a vertical axis. A second arm is attached to the other end of the said first arms by a second pivot means having a vertical axis.

More specifically, the pivot mount includes two vertically-spaced bearings and the first pivot means includes a vertical shaft that passes through both bearings. The outer end of the second arm is provided with a stop to prevent clothes hangers from sliding off of the end and it is provided with a vertical supporting leg have a caster on its lower end.

DESCRIPTION OF THE PREFERRED EMBODIMENT

Figure 1:
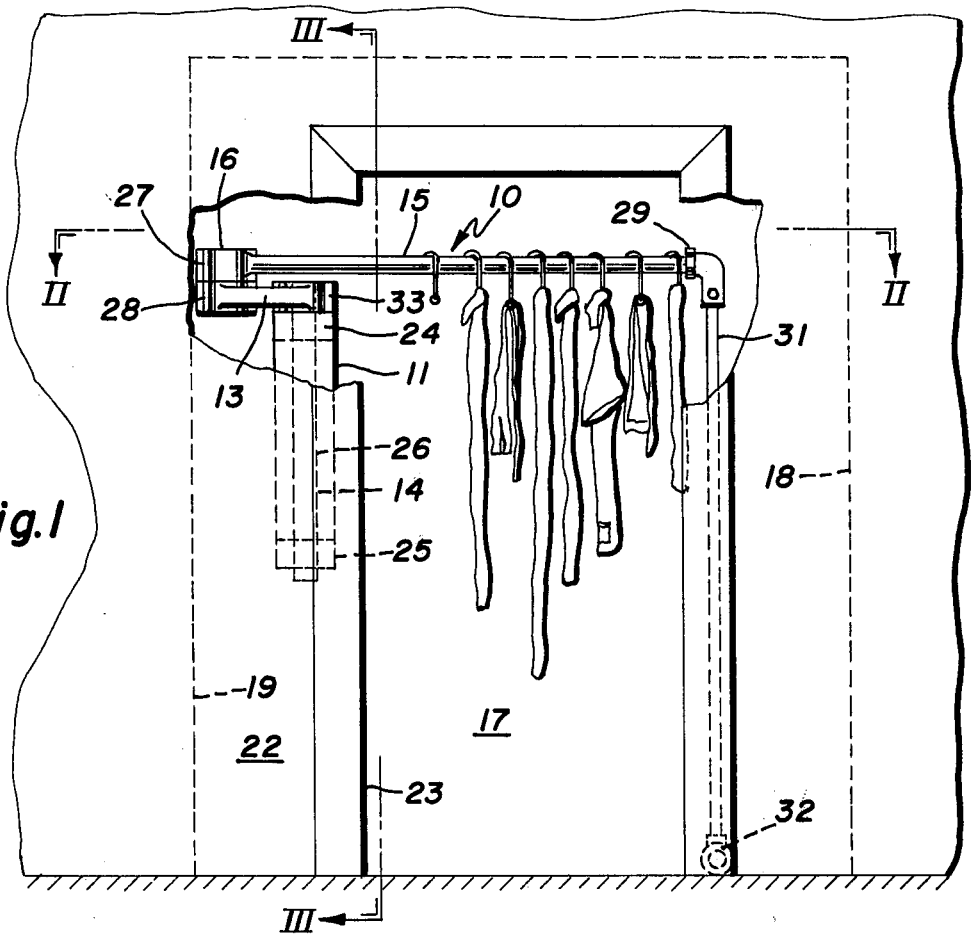
FIG. 1 is a front elevational view of a clothes rack shown in use with a closet.

Referring first to FIG. 1, wherein are best shown the general features of the invention, the retractable clothes rack, indicated generally by the reference numeral 10, is shown as including a pivot mount 11 secured to a vertical surface 12. A first arm 13 is attached to said mount by a pivot means 14, making the arm swingable in a horizontal plane. A rod or second arm 15 is provided, having one end attached to the other end of the said first arm by a pivot means 16, making the said second arm swingable in a horizontal plane.

Figure 2:
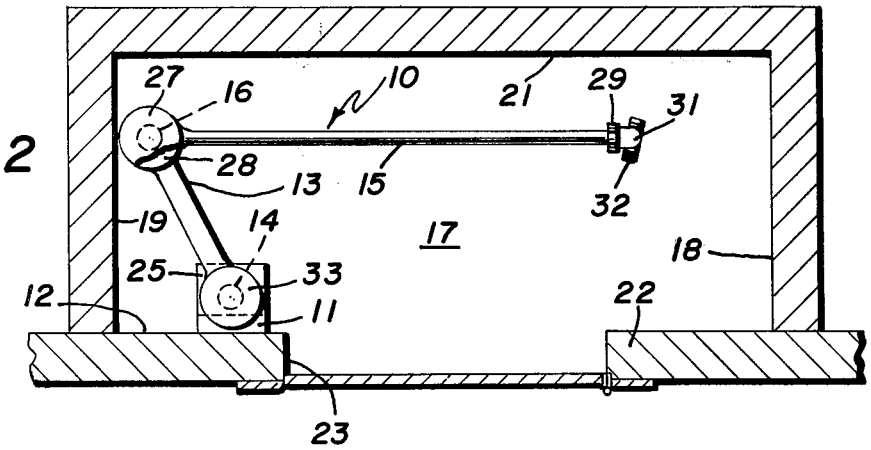
FIG. 2 is a horizontal sectional view showing the clothes rack in storage position, as viewed along the line II—II of FIG. 1.
Figure 3:
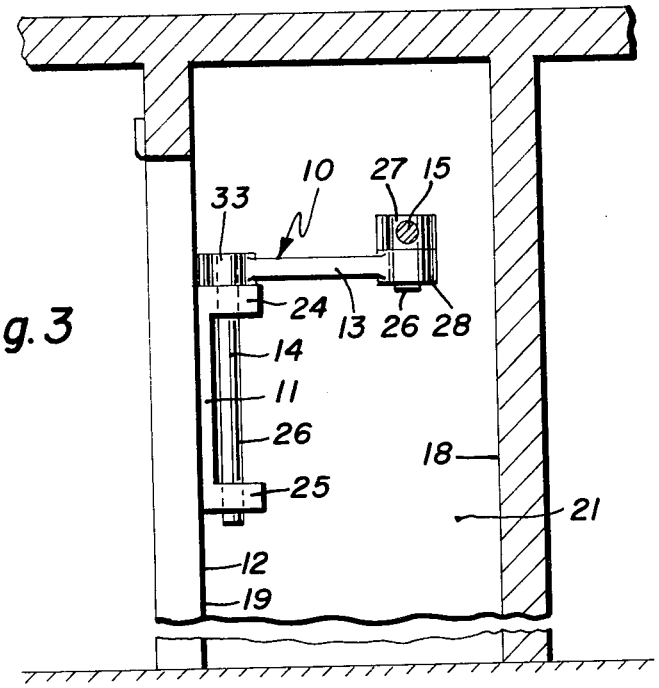
FIG. 3 is a vertical sectional view of the invention taken on the line III—III of FIG. 1.

The details of the invention are shown in FIGS. 1, 2, and 3, wherein the retractable clothes rack 10 is shown in use in connection with an inner closet space 17 defined by a right side wall 18, a left side wall 19, a back wall 21, and a front wall 22. A doorway 23 located in the front wall intermediate of the right and the left side walls. The pivot mount 11 is attached to the inside of the front wall 22 and the first arm 13 is attached at one end to the pivot mount by the first pivot means 14 and the second arm 15 is attached to the other end of the said first arm 13 by a second pivot means 16 having a vertical axis.

As is best shown in FIG. 3, the pivot mount 11 includes two vertically-spaced bearings 24 and 25 and the first pivot means 14 includes a vertical shaft 26 that passes through both bearings. The second pivot means 16 includes two cylindrical bodies 27 and 28 lying one above the other with radial faces in sliding contact, each body being integral with one of the arms 13 and 15, respectively. The bodies have a diameter substantially larger than the thickness of the arms. The outer end of the second arm 15 is provided with a stop 29 which serves to prevent clothes hangers from sliding from that end of the arm. The outer end of the second arm 15 is also provided with a vertical supporting leg 31 whose lower end is provided with a caster 32.

The second arm 15 is telescopingly adjustable in length and is provided with a set screw to lock it in its adjusted length. The vertical supporting arm 31 is also telescopingly adjustable in length and is provided with a set screw to lock it in its adjusted length. The first pivot pin 14 includes a cylindrical body 33 which is integral with the first arm 13 and has a large radial bottom surface that rests on an upper surface of the upper bearing 24.

Figure 4:
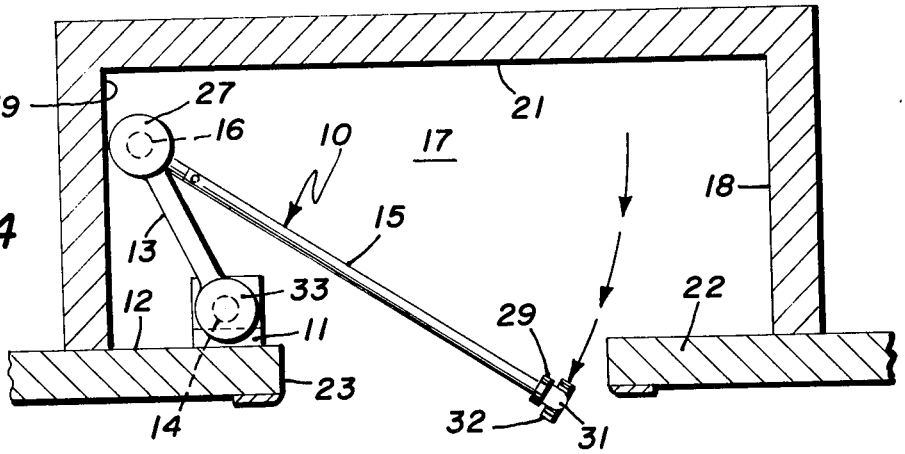
FIG. 4 is a plan view of the invention showing it in a second intermediate position.
Figure 5:
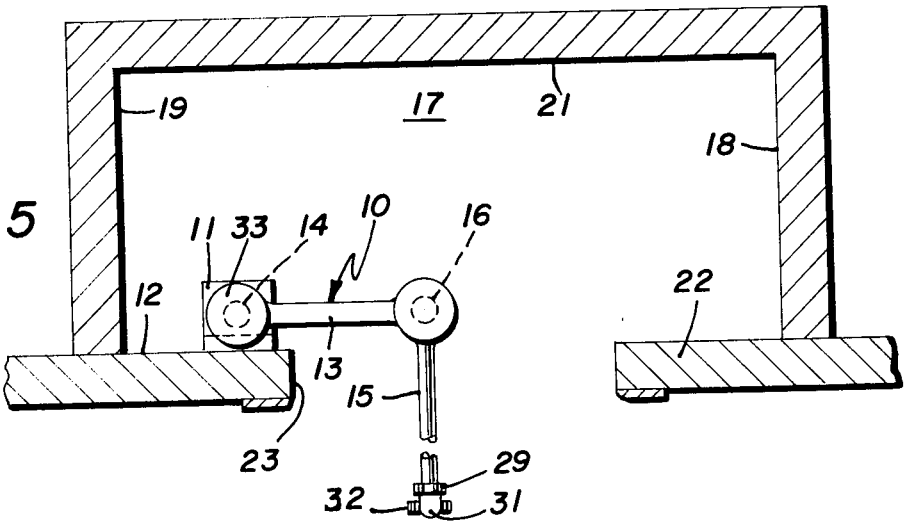
FIG. 5 is a plan view of the invention showing it in a third access position.

The operation and advantages of the present invention will be clearly understood in view of the above description. During its use, the clothes rack is normally in the condition shown in FIGS. 1, 2, and 3; the second arm 15 is located spaced from and parallel to the back wall 21. At that time, the rod or arm is provided with clothing hung in the usual way from clothes hangers. The hangers can be evenly distributed along the length from the pivot means 16 on the one end to the stop 29 at the other end. The stop, of course, prevents the clothing from sliding off the bar. Since the inner space 17 is a typical closet (which is dark to begin with and becomes even darker when a person stands in the doorway 23 to obtain an article of clothing), it is difficult to see which clothing is desired. Furthermore, it is difficult to remove the clothing without disrupting other adjacent clothing that is to be left on the arm. For that reason, the arm 15 is swung about the axis of the second pivot means 16 in the manner shown in FIG. 4. Once that swing has been completed, the outer end of the arm 15 lies midway in the doorway 23. At that time the arms 13 and 15 are swung about the first pivot means 14 as a unit with very little angular change between them, so that the arm 15 proceeds out of the doorway. Eventually, the arm 13 arrives at a position parallel to the front wall 22 with the arm 15 extending at a right angle to it out into the room. At that time all of the clothing on the arm is exposed to the light and a selection of color and particular clothing can be made. Furthermore, being in the open it is possible to move apart the clothing that lies on either side of the desired piece of clothing, so that it can be removed without difficulty and without causing other pieces of clothing to fall on the floor. Once the article of clothing has been selected or an article of clothing place on the rack, the procedure is reversed and the apparatus is returned to the condition shown in FIG. 1 for storage. If a very heavy load of clothing is placed on the arm 15, the outer vertical supporting leg 31 serves to support this weight. Nevertheless, it is possible for the floor of the closet to be occupied by shoes and the like in the usual way; all that is necessary is that a curved clear path be retained to permit the caster 32 to move across the floor of the closet out into the open.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Retractable clothing rack, for use in an inner space having a right side wall, a left side wall, a back wall, and a front wall with a doorway situated in said front wall intermediate between the right and the left side walls, comprising:

(a) a pivot mount attached to the inside of the front wall, said pivot mount comprising two vertically-spaced bearings, (b) a first arm, one end of which has a large radial bottom surface that rests on the upper surface of the upper bearing, (c) a first pivot means comprising a vertical shaft that passes through said one end of the first arm and both of said bearings for permitting said first arm to swing in a horizontal plane, (d) a second arm one end of which is attached to the other end of the first arm by a second pivot means having a vertical axis for permitting said second arm to swing in a horizontal plane, said second arm being telescopingly horizontal plane, said second arm being telescopingly adjustable in length, (e) a supporting leg telescopingly adjustable in length attached to the other end of said second arm, (f) a caster on the lower end of the supporting leg.

2. Retractable clothing rack as recited in claim 1, wherein the second pivot means includes two cylindrical bodies lying one above the other with radial faces in sliding contact, each integral with one of the arms and having a diameter substantially larger than the thickness of its arm.

3. Retractable clothing rack as recited in claim 1, wherein the outer end of the second arm is provided with a stop to prevent clothes hangers from sliding from that end.

* * * * *

UNITED STATES PATENT AND TRADEMARK OFFICE

CERTIFICATE OF CORRECTION

PATENT NO. : 4,252,242

DATED : February 24, 1981

INVENTOR(S) : Charles L. Tudor

It is certified that error appears in the above-identified patent and that said Letters Patent are hereby corrected as shown below:

Claim 1, lines 20 and 21, delete "horizontal plane, said second arm being telescopingly".

Signed and Sealed this

*Seventh* Day of *June 1983*

[SEAL]

*Attest:*

DONALD J. QUIGG

*Attesting Officer*

*Acting Commissioner of Patents and Trademarks*